US012156565B2

(12) United States Patent
Lee

(10) Patent No.: US 12,156,565 B2
(45) Date of Patent: Dec. 3, 2024

(54) VARIABLE HELMET

(71) Applicant: Nature Mobility Co., Ltd., Jeju-si (KR)

(72) Inventor: Ju Sang Lee, Seoul (KR)

(73) Assignee: Nature Mobility Co., Ltd., Jeju-si (KR)

( * ) Notice: Subject to any disclaimer, the term of this patent is extended or adjusted under 35 U.S.C. 154(b) by 0 days.

(21) Appl. No.: 17/032,812

(22) Filed: Sep. 25, 2020

(65) Prior Publication Data

US 2021/0204632 A1 Jul. 8, 2021

(30) Foreign Application Priority Data

Jan. 3, 2020 (KR) ..... 10-2020-0000866

(51) Int. Cl.

*A42B 3/32* (2006.01)
*A42B 3/06* (2006.01)
*A42B 3/08* (2006.01)

(52) U.S. Cl.

CPC ..... *A42B 3/324* (2013.01); *A42B 3/06* (2013.01); *A42B 3/08* (2013.01)

(58) Field of Classification Search

CPC .. A42B 3/324; A42B 3/06; A42B 3/08; A42B 3/125; A42B 3/32; A42B 3/069; A42B 1/201; A42B 3/322; A42B 3/063; A42B 3/006; A42B 3/066; A63B 71/10

USPC ... 2/414, 171, 171.03, 200.3, 410, 411, 425; D2/870

See application file for complete search history.

(56) References Cited

U.S. PATENT DOCUMENTS 3,991,422 A * 11/1976 Saotome ..... A42B 3/322 2/410
9,693,594 B1 * 7/2017 Castro ..... A42B 1/08
2019/0307199 A1 * 10/2019 Hall ..... A42B 3/127

FOREIGN PATENT DOCUMENTS

CN 108391889 A * 8/2018 ..... A42B 3/0406
JP 2010084314 A * 4/2010 ..... A42B 1/201
JP 2017075415 A * 4/2017
JP 2019073823 A * 5/2019
KR 1008899369 * 3/2009
KR 10-2015-0088021 A 7/2015

(Continued)

OTHER PUBLICATIONS

The extended European search report issued by the European Patent Office on Mar. 26, 2021, which corresponds to European Patent Application No. 20200475.0-1017 and is related to U.S. Appl. No. 17/032,812.

*Primary Examiner* — Nathan E Durham
*Assistant Examiner* — Abby M Spatz
(74) *Attorney, Agent, or Firm* — Studebaker & Brackett PC

(57) ABSTRACT

The present disclosure relates to a variable helmet that can be unfolded flat and carried or kept when not in use. A configuration of the variable helmet is characterized by including a protective pad in which a plurality of unit pads are planarly coupled like a mosaic so that the protective pad is in a hemispherical shape to cover and protect a head of a wearer and is able to be unfolded flat like a plate, the protective pad having unevenness portions provided in a sawtooth shape at both ends thereof; both-end fixing means allowing the unit pads to have a hemispherical shape by tightening the both ends of the protective pad; and a chin strap allowing the protective pad to be fixed in a state in which the protective pad is covered on the head.

3 Claims, 8 Drawing Sheets

(56) References Cited

FOREIGN PATENT DOCUMENTS

| | | | | |
|---|---|---|---|---|
| KR | 10-2015-0096049 | A | 8/2015 | |
| KR | 10-2015-0113232 | A | 10/2015 | |
| KR | 10-1576364 | B1 | 12/2015 | |
| KR | 10-1643344 | B1 | 7/2016 | |
| KR | 10-2018-0049698 | A | 5/2018 | |
| WO | WO-2014126321 | A1 * | 8/2014 | ..... A42B 3/322 |
| WO | WO-2019076689 | A1 * | 4/2019 | ..... A42B 3/06 |

* cited by examiner

VARIABLE HELMET

CROSS-REFERENCE TO RELATED APPLICATIONS

This application claims the priority and benefit of Korean Patent Application No. 10-2020-0000866 filed on Jan. 3, 2020, with the Korean Intellectual Property Office, the disclosure of which is incorporated herein by reference.

BACKGROUND

Technical Field

The present disclosure relates to a helmet, and more specifically, to a variable helmet capable of being easily carried and kept by allowing for a reduction in volume thereof when not in use.

Description of the Related Art

Helmets are safety equipment that should be worn for safety in leisure activities to enjoy speed, such as inline skating, electric kickboard riding, mountain biking and the like. If an accident occurs without wearing a helmet, fatal damage is caused. However, despite this risk, there are many cases in which no helmet is used. This may be because it is inconvenient to use the helmet and carry it. The helmet does not weigh much due to a property thereof, but it is difficult to carry the helmet in a general bag due to a large size thereof. For this reason, the frequency of using the helmet is reduced.

Due to this limitation, a foldable helmet, as disclosed in Korean Patent Application No. 10-2014-0035677, has been proposed, but the helmet may not protect a user's body from a significant impact because of its low strength, and may cause noise due to its high resistance when the user wears it and moves at high speed.

In addition, Korean Patent Application No. 10-2014-0016978 has suggested a foldable air tube helmet, but this has inconvenience in that the tube should be inflated when the helmet is in use. Also, the possibility of tube damage due to high pressure and heat cannot be excluded.

RELATED ART DOCUMENT (Patent Document 0001) Korean Patent Application No. 10-2014-0035677 (Patent Document 0002) Korean Patent Application No. 10-2014-0016978

SUMMARY

For the above problems, an aspect of the present disclosure is intended to increase the frequency of use of a helmet as a safety device by resolving inconvenience in its use. More specifically, an object of the present disclosure is to provide a variable helmet which is capable of being easily carried and kept by allowing for a reduction in volume thereof and capable of being conveniently used without inconvenience even when in use, and which has no aesthetic damage.

Such an object is achieved by a variable helmet characterized by including a protective pad in which a plurality of unit pads are planarly coupled like a mosaic so that the protective pad is in a hemispherical shape to cover and protect a head and is able to be unfolded flat like a plate, the protective pad having unevenness portions provided in a sawtooth shape at both ends thereof; both-end fixing means allowing the unit pads to have a hemispherical shape by tightening the both ends of the protective pad; and a chin strap allowing the protective pad to be fixed in a state in which the protective pad is covered on the head, the chin strap being installed in the protective pad so as to support a chin of a wearer.

According to another feature of the present disclosure, the both-end fixing means may include insertion portions that are provided in both edges of the protective pad; and adjustment strap members that are fitted into the insertion portions to thereby change a shape of the protective pad.

According to another feature of the present disclosure, the both-end fixing means may include one or more of a magnet body, a Velcro™ tape, or a snap button.

According to another feature of the present disclosure, the protective pad may include a central protection unit in which a plurality of first unit protection plates are arranged in a line; first side protection units connected to both left and right sides of the central protection unit and including a plurality of second unit protection plates arranged in two lines; second side protection units connected to both left and right sides of the first side protection units and including a plurality of third unit protection plates symmetrically arranged in two lines; and third side protection units connected to both left and right sides of the second side protection units and including a plurality of fourth unit protection plates symmetrically arranged in two lines, the insertion portions being provided in the plurality of fourth unit protection plates.

Respective connection areas of the first, second, third, and fourth unit protection plates are formed of a flexible material to thereby allow the protective pad to have a hemispherical shape.

According to still another feature of the present disclosure, the first, second, third, and fourth unit protection plates may include a cover plate having rigidity, capable of protecting the head from an external impact; a soft pad having flexibility, that is attached to a bottom surface of the cover plate; and a buffer pad for buffering an impact, that is attached to a bottom surface of the soft pad.

According to the above configuration, there is provided a variable helmet that is easily carried and kept by allowing for a considerable reduction in volume thereof since it can be unfolded flat like a notebook or a book. In addition, there is provided a variable helmet that can be used conveniently because only a strap member thereof needs to be pulled and fixed when in use. As such, there is provided a variable helmet that can prevent various safety accidents in advance by encouraging the use of the helmet because of its convenient use.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF EMBODIMENTS

Hereinafter, embodiments of the present disclosure will be described in detail with reference to the accompanying drawings attached to the specification. An exemplary embodiment of the present disclosure will be described with reference to FIGS. 1 to 4 simultaneously. The remaining drawings will be referred when necessary.

A variable helmet according to the present disclosure is worn and used to protect a head of a wearer from an impact in various leisure activities. Therefore, the scope of the present disclosure should not be limited by specific usage of the helmet.

The variable helmet of the present disclosure includes a protective pad 100, both-end fixing means, and a chin strap.

Figure 6:
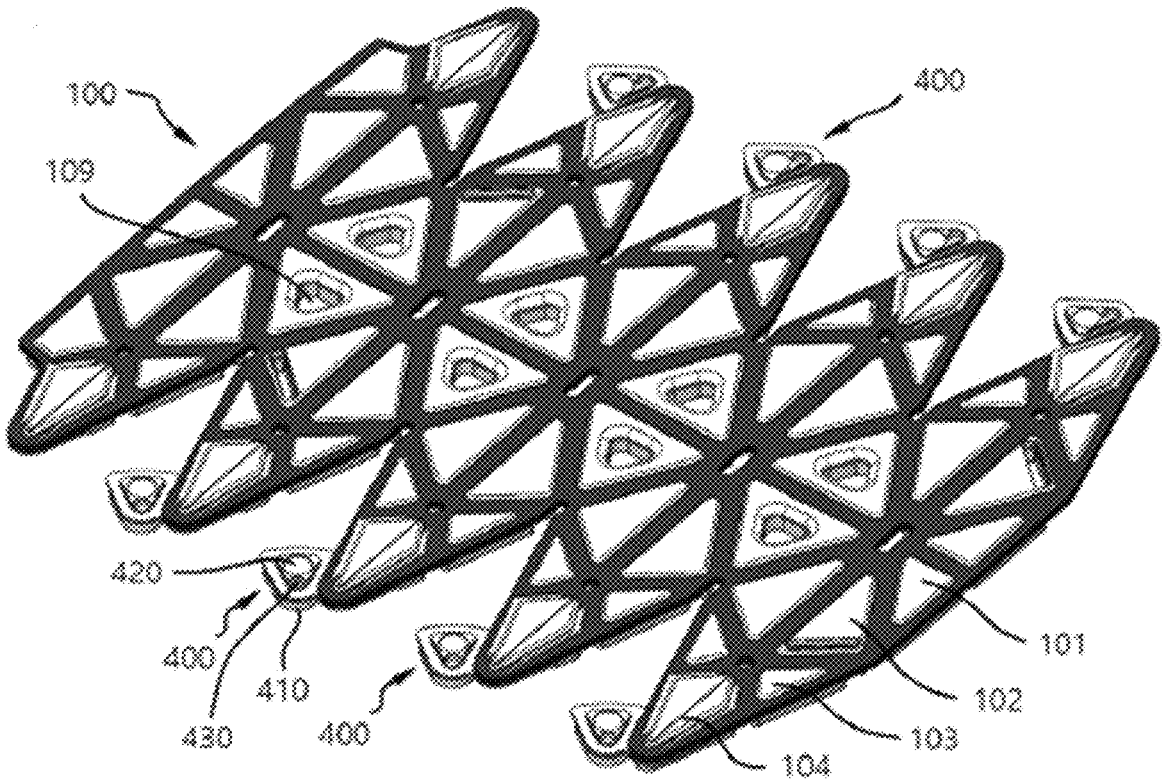
FIG. 6 is a perspective view of an unfolded state of a variable helmet according to another exemplary embodiment of the present disclosure.
Figure 7:
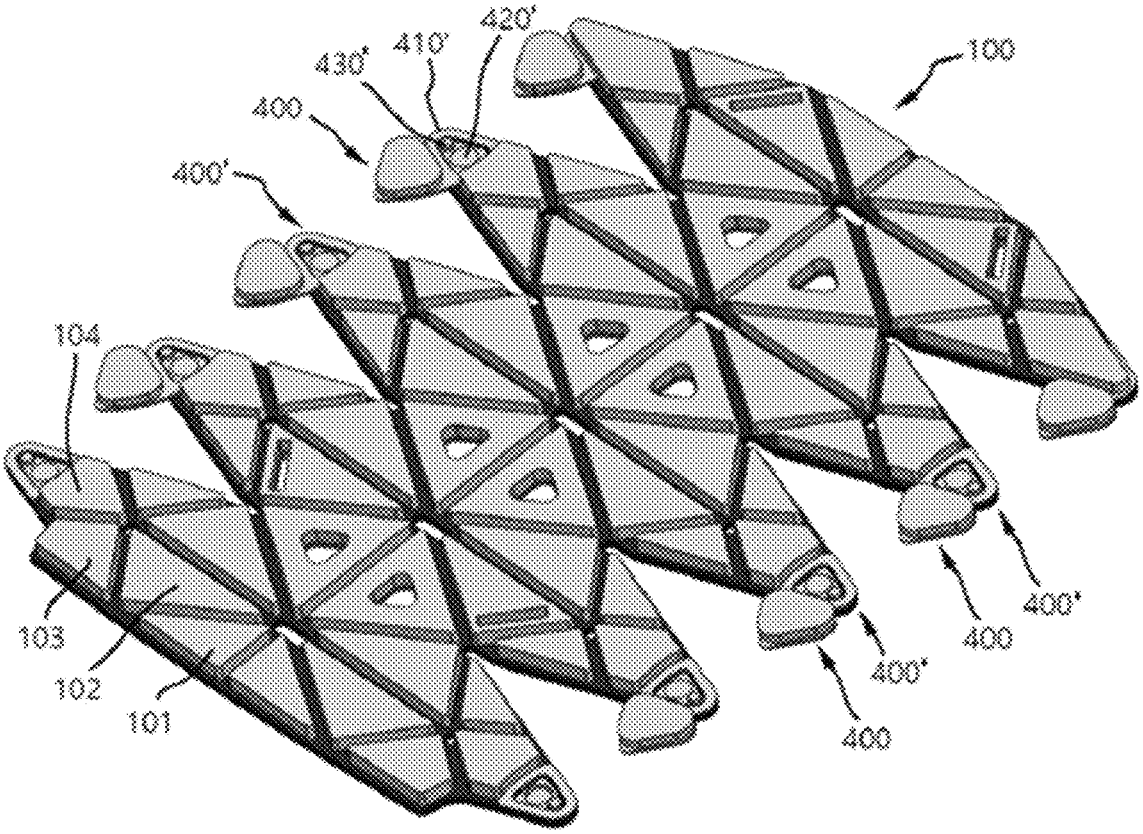
FIG. 7 is a bottom perspective view of the unfolded state of the variable helmet according to another exemplary embodiment of the present disclosure.

The both-end fixing means are adjustment strap members 200 and 300 according to the exemplary embodiment and are magnets 410 according to another exemplary embodiment shown in FIGS. 6 to 7. First, the former will be described first, and then, another exemplary embodiment will be described.

According to the exemplary embodiment shown in FIGS. 1 to 5, the adjustment strap members 200 and 300 and the chin strap are integrally formed. That is, the adjustment strap members 200 and 300 also serve as the chin strap. They can be separate from each other.

Figure 1:
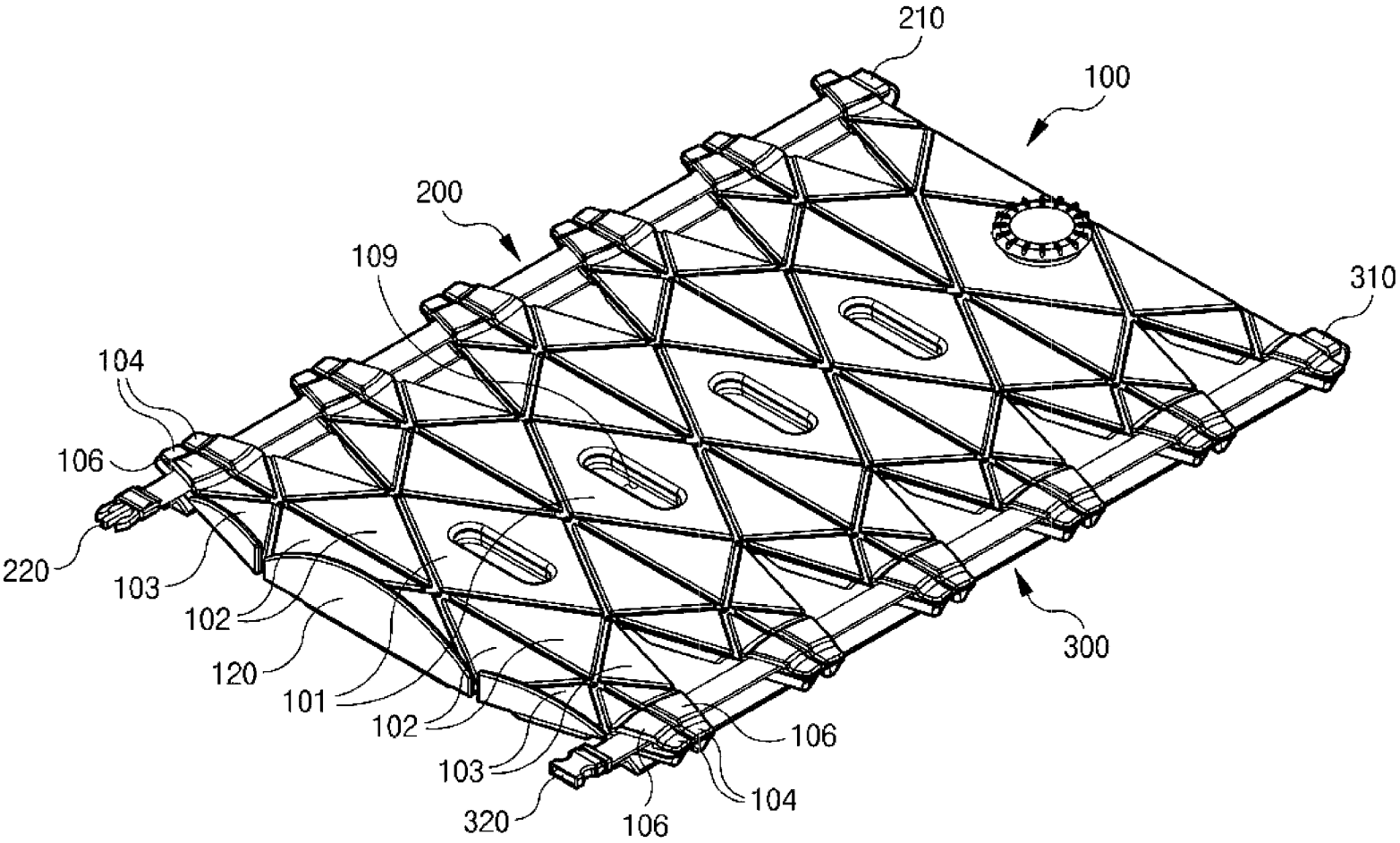
FIG. 1 is a perspective view of an unfolded state of a variable helmet according to an exemplary embodiment of the present disclosure.
Figure 2:
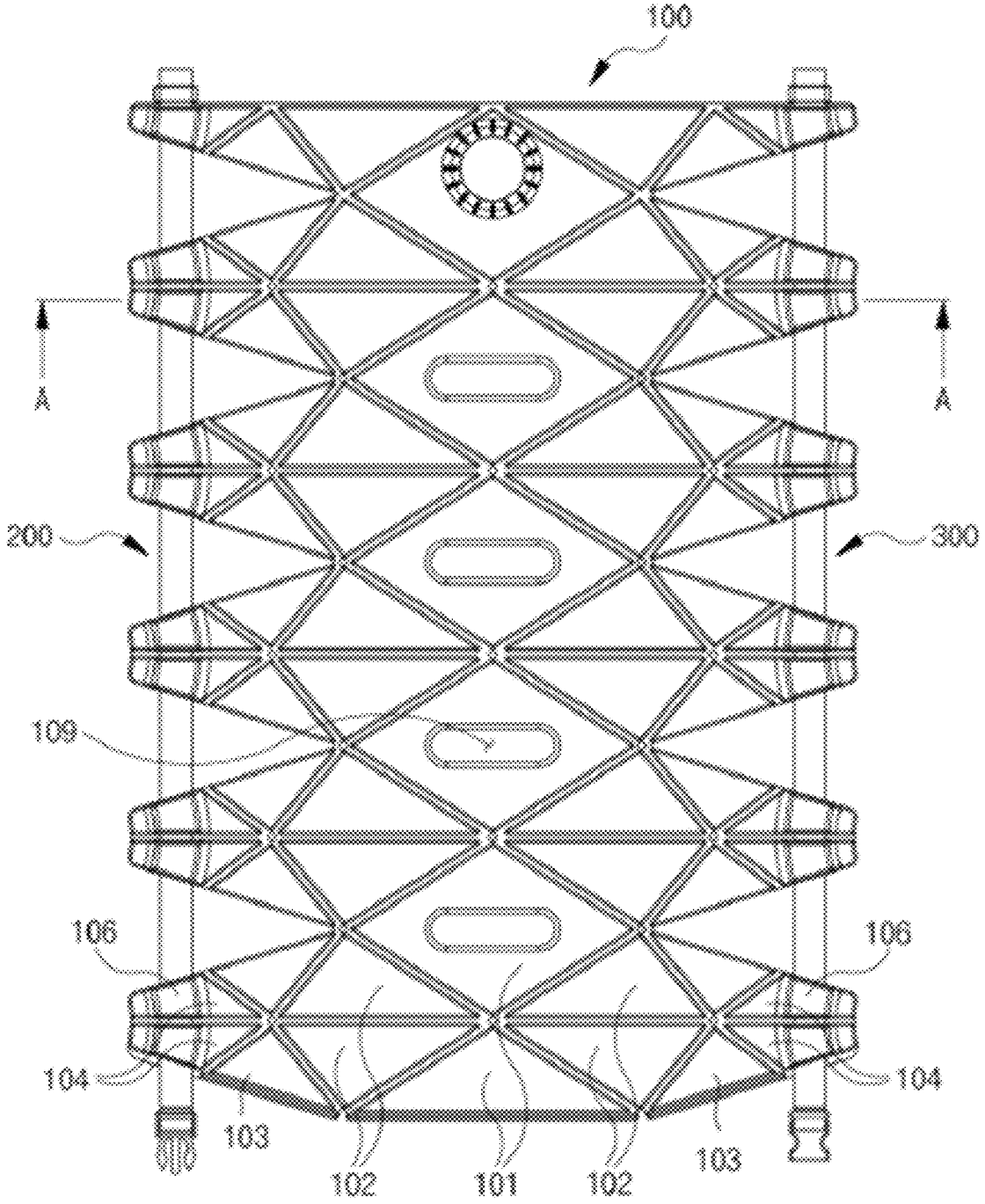
FIG. 2 is a plan view of the unfolded state of the variable helmet according to an exemplary embodiment of the present disclosure.

The protective pad 100 may be in a hemispherical shape so as to cover and protect the head (refer to FIGS. 3 and 4), and may be unfolded flat like a book, notebook or a plate according to a user's adjustment (refer to FIGS. 1 and 2). In the protective pad 100, a plurality of unit pads are planarly coupled like a mosaic, and unevenness portions are provided in a sawtooth shape at both ends of the protective pad 100.

The adjustment strap members 200 and 300 are installed on both edges of the protective pad 100 and are tightened by reducing lengths thereof or loosened by increasing lengths thereof, thereby changing a shape of the protective pad 100.

The adjustment strap members 200 and 300 allow the protective pad 100 to be fixed in a state in which the protective pad 100 is covered on the head and serve as the chin strap capable of supporting a wearer's chin, as described above. The adjustment strap members 200 and 300 may include buckles 220 and 320, similar to a general chin strap, and may include a chin protective pad (not shown) supported on the chin.

According to features of the present disclosure, the protective pad 100 includes a central protection unit 101, first side protection units 102, second side protection units 103, and third side protection units 104

The central protection unit 101 is a unit in which a plurality of first unit protection plates are arranged in a line and is disposed in a central portion of a human body including a crown of the head. As shown, the first unit protection plates have a rhombus shape, and a ventilation hole 109 is provided in the center of the entirety or a portion of the first unit protection plates. If necessary, an occipital pressing means such as a dial may be provided. The occipital pressing means may be a component, which is inflated toward an occipital region as rotation of the dial is adjusted to thereby securely fix the helmet and protect the occipital region.

The first side protection units 102 are symmetrically connected to both left and right sides of the central protection unit 101 and are composed of a plurality of second unit protection plates arranged in two lines. As shown, the second unit protection plate is also in a rhombus shape. Furthermore, a single second unit protection plate can be further divided. As shown, the second unit protection plate is divided into two sub-unit protection plates that are in a triangular shape.

The second side protection units 103 are connected to both left and right sides of the first side protection units 102. The second side protection units 103 are composed of a plurality of third unit protection plates that are arranged symmetrically in two lines.

The third side protection units 104 are connected to both left and right sides of the second side protection units 103. The third side protection units 104 are composed of a plurality of fourth unit protection plates that are arranged symmetrically in two lines.

The protective pad 100 has a rectangular shape overall, and the both ends thereof onto which the second and third side protection units 103 and 104 are mounted have a sawtooth shape. This is a shape that results naturally by unfolding the hemisphere flatwise.

The third side protection units 104 may be provided with insertion portions 106 into which the adjustment strap members 200 and 300 can be fitted. Since the adjustment strap members 200 and 300 are in a flat shape, the insertion portions 106 also have a flat hole shape in cross-section thereof. Stoppers 210 and 310 may be provided at one sides of the adjustment strap members 200 and 300 to limit the adjustment strap members 200 and 300 so that the adjustment strap members 200 and 300 are pulled in a certain form. In addition, a strap fixing means such as a clip (not shown) may be provided to maintain a state of FIG. 4 in which the adjustment strap members 200 and 300 are pulled.

A method of mounting the adjustment strap members 200 and 300 onto the protective pad 100 or a configuration of pulling the adjustment strap members 200 and 300 or fixing the adjustment strap members 200 and 300 in a pulled state can be variously changed.

Figure 3:
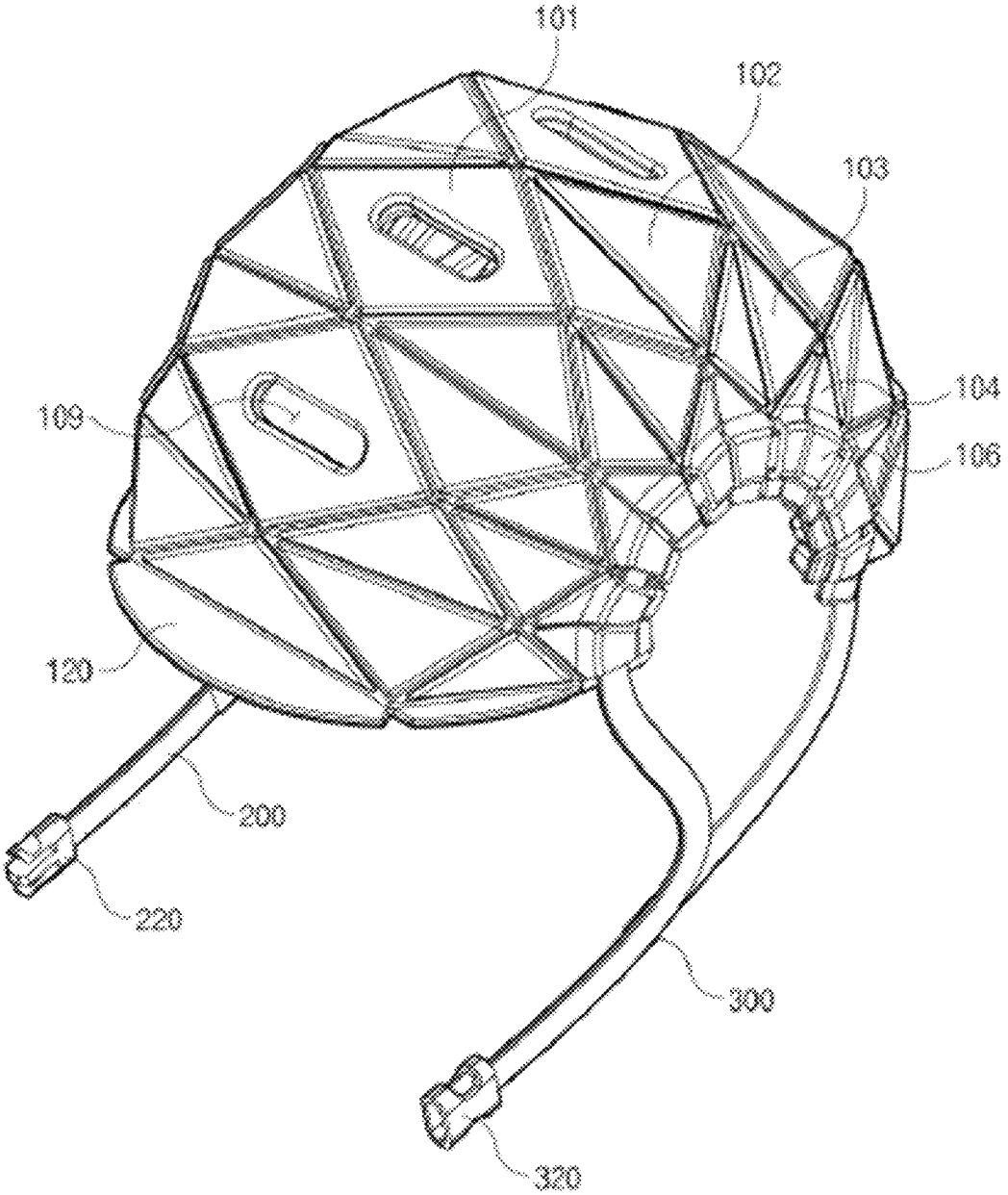
FIG. 3 is a perspective view showing a modified state into a helmet, of the variable helmet according to an exemplary embodiment of the present disclosure.
Figure 4:
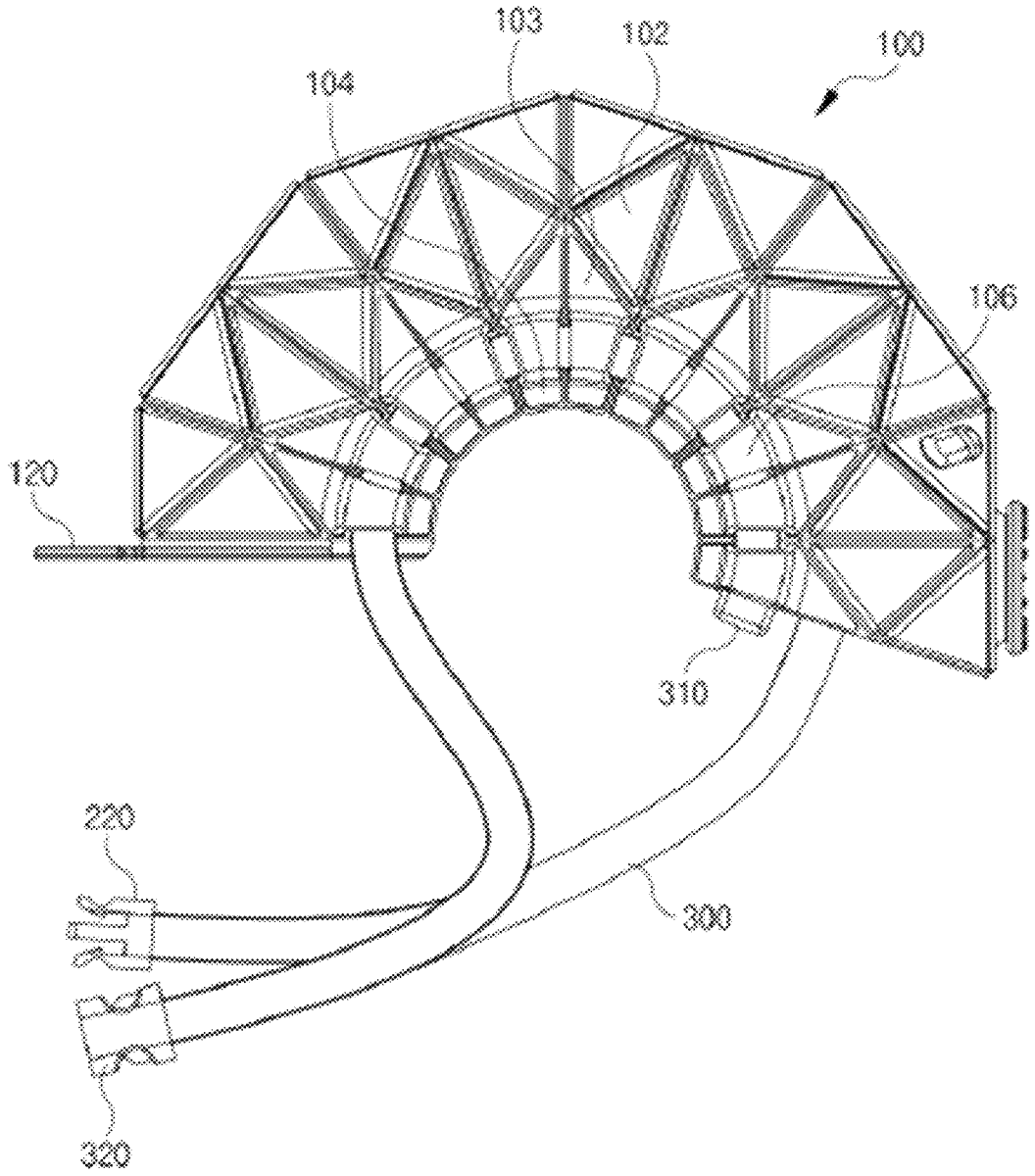
FIG. 4 is a side view showing a modified state into a helmet, of the variable helmet according to an exemplary embodiment of the present disclosure.

According to such a configuration, the protective pad 100 has a mosaic shape overall, and connection areas of respective mosaic pieces, that is, connection areas of the first, second, third, and fourth unit protection plates, are formed of a flexible material. Accordingly, the protective pad 100 can be bent in a hemispherical shape as shown in FIGS. 3 and 4.

In this manner, the respective first, second, third, and fourth unit protection plates may be subdivided to be more suitable for a shape of the body. However, if they are excessively subdivided, since protection functions may be degraded, and inconvenience is caused in the manufacture thereof, it is desirable that they have an appropriate size.

Figure 5:
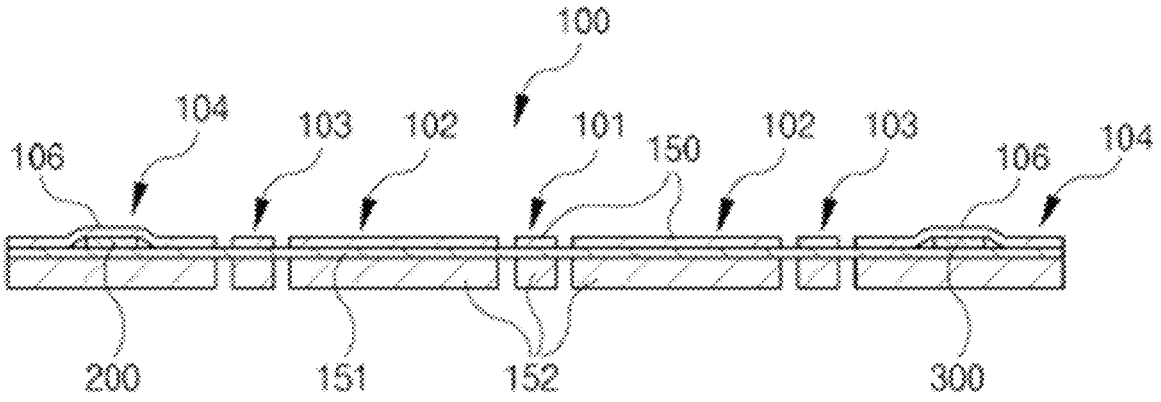
FIG. 5 is a schematic cross-sectional view taken along line A-A of FIG. 2.

Meanwhile, a layer structure of the protective pad 100 is as shown in FIG. 5. That is, the protective pad 100 includes a cover plate 150 having rigidity, capable of protecting the head from an external impact, a soft pad 151 having flexibility, that is attached to a bottom surface of the cover plate 150, and a buffer pad 152 for buffering an impact, that is attached to a bottom surface of the soft pad 151. An edge of the cover plate 150 may be covered by packing or coating such as urethane or silicone. This is to prevent a sharp end portion from being exposed to the outside.

The soft pad 151 may be formed of silicone, rubber, urethane, fabric, leather, or the like. The soft pad 151 is preferably formed of silicone, rubber, or urethane to have elasticity. The soft pad 151 is integrally formed over the entirety of the protective pad 100. For the buffer pad 152, a lightweight foaming material such as EPP or EPS is suitable. The buffer pad 152 may have a three-layer structure in which an upper foaming body, an intermediate plate formed of a rigid metal or synthetic resin material, and a lower foaming body are bonded in order to maximize impact absorption.

Although not shown, a headband formed of a material such as cotton for absorbing sweat may be further installed on a bottom surface of the buffer pad 152. A visor 120 for blocking sunlight may be integrally attached to an end of the central protection unit 100.

Figure 8:
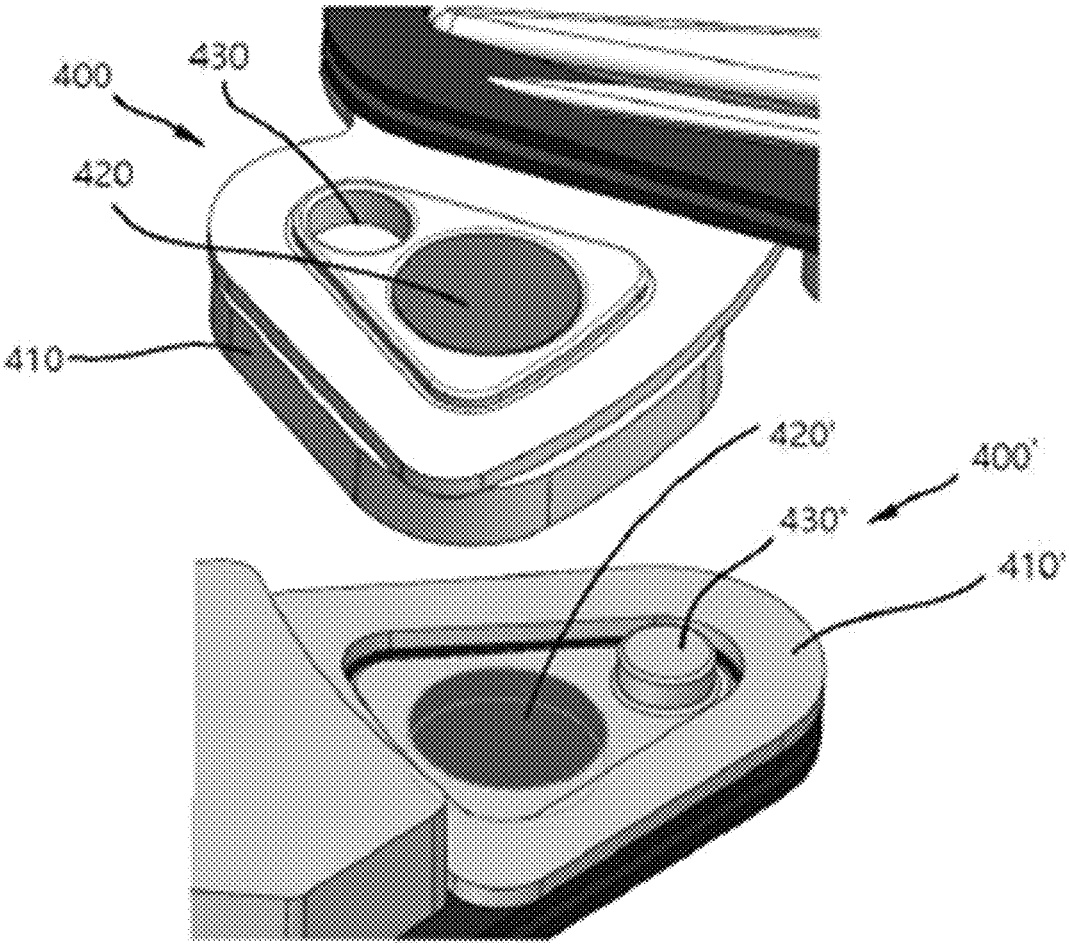
FIG. 8 is a configuration view of a both-end fixing means of a variable helmet according to still another exemplary embodiment of the present disclosure.

Hereinafter, another exemplary embodiment of the present disclosure will be described with reference to FIGS. 6 to 8. This embodiment relates to a both-end fixing means for fixing a flat protective pad in a hemispherical shape. In FIGS. 6 to 7, illustration of a chin strap is omitted. However, a chin strap insertion hole into which a chin strap is fitted is provided in the protective pad 100.

Magnet fixing portions 400 and 400' are provided on the third side protection units 104 that constitute unevenness parts at the both ends of the protective pad 100. The magnet fixing portions 400 and 400' include fixing plates 410 and 410' and magnetic bodies 420 and 420' installed on the fixing plates 410 and 410'

One magnet fixing portion 400 (hereinafter, referred to as 'first magnet fixing portion') is formed to protrude from one side of the third side protection unit 104 like a hump, and the other magnet fixing portion 400' (hereinafter, referred to as 'second magnet fixing portion') is provided in the third side protection unit 104 itself. The first magnet fixing portion 400 is fixed by magnetic force in a state in which it is superposed onto the second magnet fixing portion 400' adjacent thereto. Accordingly, they can be in close contact with and fixed to each other between the adjacent third side protection units 104.

To further improve fixing force, unevenness coupling parts 430 and 430' composed of protrusions and holes may be provided in the respective magnet fixing portions 400 and 400'. The unevenness coupling parts 430 and 430' may be replaced with snap buttons. In addition, the magnet fixing portions 400 and 400' may be replaced with Velcro™ tapes, and may be used in combination therewith, in some cases.

Figure 9:
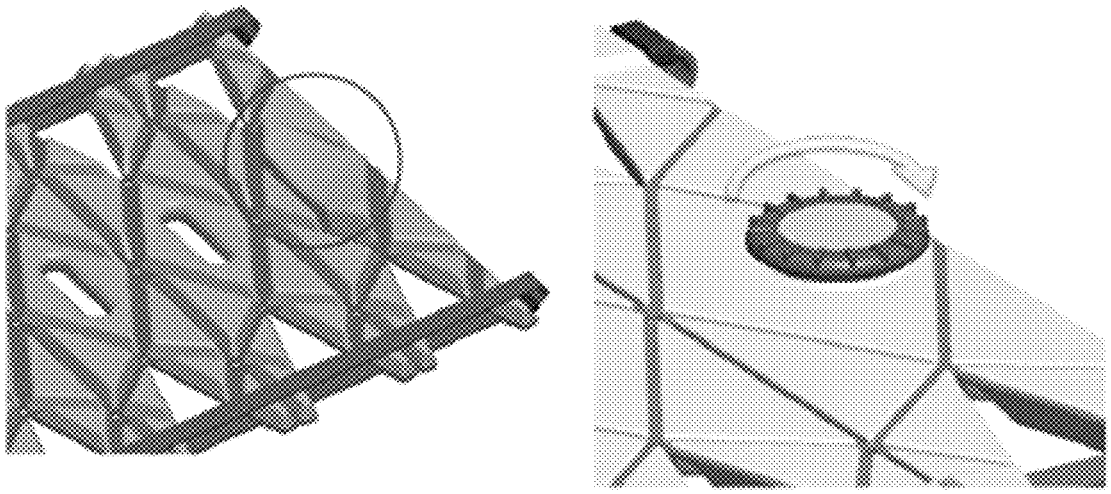
FIG. 9 is a view illustrating a jog which is provided at a variable helmet according to still another exemplary embodiment of the present disclosure.

Meanwhile, as shown in FIG. 9, a circular indicator moves back and forth according to rotation of a jog configured on the plane, so that a size adjustment according to the head can be allowed.

Figure 10:
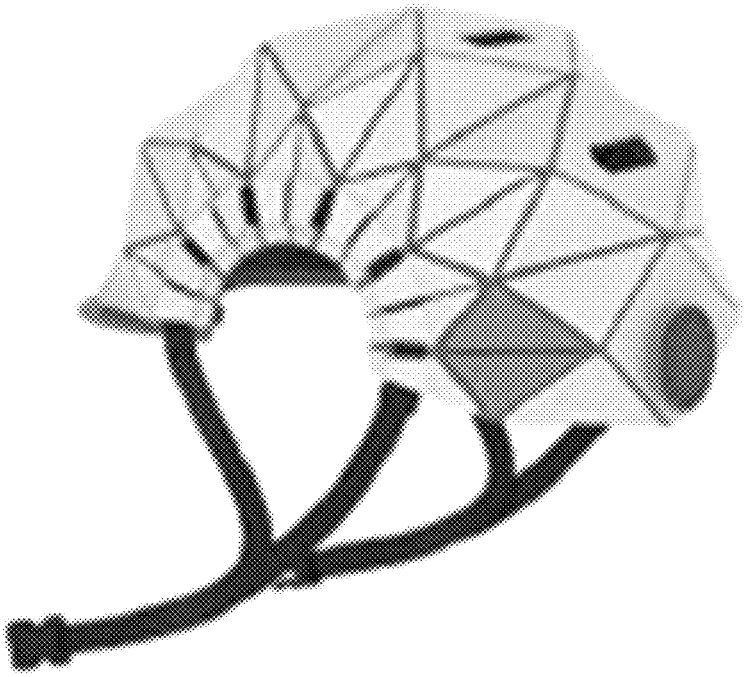
FIG. 10 is a view illustrating a surface light emitting body which is provided in a variable helmet according to still another exemplary embodiment of the present disclosure.

In addition, as shown in FIG. 10, it may be used as a direction indicator lamp through surface light emission.

Those described above are only some examples based on the technical idea of the present disclosure. Persons having ordinary skill in the art will be able to perform various modifications using those exemplified without going beyond the scope of the technical idea of the present disclosure which is expressed through the claims. For example, all exemplary embodiments described above may be freely combined and implemented by those skilled in the art, and any combination should be interpreted as being included in the scope of the present disclosure.

What is claimed is:

1. A variable helmet comprising:

a protective pad in which a plurality of unit pads are planarly coupled like a mosaic so that the protective pad is in a hemispherical shape that is configured to cover and protect a head and is able to be unfolded flat like a plate, the protective pad having unevenness portions provided in a sawtooth shape at both ends thereof;

adjustment strap members allowing the plurality of unit pads to have a hemispherical shape by tightening the both ends of the protective pad; and a chin strap allowing the protective pad to be fixed in a state in which the protective pad is configured to be covered on the head, the chin strap being installed in the protective pad so as to be configured to support a chin of a wearer, wherein the protective pad comprises:

a plurality of first unit protection plates, which are arranged in a line;

first side protection units connected to both left and right sides of the plurality of first unit protection plates, and including a plurality of second unit protection plates arranged in two lines;

second side protection units connected to both left and right sides of the first side protection units and including a plurality of third unit protection plates symmetrically arranged in two lines; and third side protection units connected to both left and right sides of the second side protection units and including a plurality of fourth unit protection plates symmetrically arranged in two lines, insertion portions being provided in the plurality of fourth unit protection plates, wherein respective connection areas of the first, second, third, and fourth unit protection plates are formed of a flexible material to thereby allow the protective pad to have a hemispherical shape, wherein the connection areas between the first unit protection plates and the second unit protection plates are arranged in a direction crossing the direction in which the plurality of first unit protection plates are arranged, the connection areas between the second unit protection plates and the third unit protection plates are arranged in a direction crossing the direction in which the plurality of first unit protection plates are arranged, and the connection areas between the third unit protection plates and the fourth unit protection plates are arranged in a direction crossing the direction in which the plurality of first unit protection plates are arranged, wherein the adjustment strap members are fitted into the insertion portions to thereby change a shape of the protective pad, wherein each of the plurality of first unit protection plates has a rhombus shape, wherein each of the second unit protection plates is divided into two sub-unit protection plates that are connected in a way allowing mutual bending deformation, wherein each of the third unit protection plates is divided into two sub-unit protection plates that are connected in a way allowing mutual bending deformation, wherein each of the fourth unit protection plates is divided into two sub-unit protection plates that are connected in a way allowing mutual bending deformation, wherein each of the two sub-unit protection plates of the second unit protection plate is triangular in shape and is connected to the first unit protection plate in a way that allows for bending deformation, wherein each of the two sub-unit protection plates of the third unit protection plate is triangular in shape and is connected to each of the two sub-unit protection plates of the second unit protection plate in a way that allows for bending deformation, wherein each of the two sub-unit protection plates of the fourth unit protection plate is connected to each of the two sub-unit protection plates of the third unit protection plate in a way that allows for bending deformation, and wherein the connection area where the two sub-unit protection plates of the second unit protection plate meet is arranged to be orthogonal to the direction in which the plurality of first unit protection plates are arranged, the connection area where the two sub-unit protection plates of the third unit protection plate meet is arranged to be orthogonal to the direction in which the plurality of first unit protection plates are arranged, the connection area where the two sub-unit protection plates of the fourth unit protection plate meet is arranged to be orthogonal to the direction in which the plurality of first unit protection plates are arranged.

2. The variable helmet of claim 1, wherein the first, second, third, and fourth unit protection plates include:

a cover plate having rigidity, capable of protecting the head from an external impact;

a soft pad having flexibility, that is attached to a bottom surface of the cover plate; and a buffer pad for buffering an impact, that is attached to a bottom surface of the soft pad.

3. The variable helmet of claim 1, wherein the adjustment strap members and the chin strap are integrally formed.

* * * * *